United States Patent [19]

Goldstein

[11] Patent Number: 4,543,178

[45] Date of Patent: Sep. 24, 1985

[54] DUAL INTENSITY MAGNETIC SEPARATION PROCESS FOR BENEFICIATION OF PLATINUM ORE

[75] Inventor: Theodore P. Goldstein, Yardley, Pa.

[73] Assignee: Mobil Oil Corporation, New York, N.Y.

[21] Appl. No.: 514,128

[22] Filed: Jul. 15, 1983

[51] Int. Cl.[4] ..... B03C 1/30; B07B 13/00

[52] U.S. Cl. ..... 209/2; 209/38; 209/212; 209/214; 209/215

[58] Field of Search ..... 209/214–215, 209/2, 38–40, 212, 213, 216, 228, 231, 232

[56] References Cited

U.S. PATENT DOCUMENTS

| | | | |
|---|---|---|---|
| 1,729,095 | 9/1929 | Crist | 209/216 X |
| 3,022,956 | 2/1962 | Haseman | 209/215 X |
| 3,502,271 | 3/1970 | Hays | 209/216 X |
| 4,294,690 | 10/1981 | Kollenz | 209/214 X |
| 4,342,640 | 8/1982 | Lewis | 209/214 X |

*Primary Examiner*—Robert B. Reeves
*Assistant Examiner*—Edward M. Wacyra
*Attorney, Agent, or Firm*—Alexander J. McKillop; Michael G. Gilman; Howard M. Flournoy

[57] ABSTRACT

A method to isolate the paramagnetic fractions of a sediment to beneficiate the platinum and platinum group element ores therein comprising a differential magnetic filtration separation process.

9 Claims, No Drawings

DUAL INTENSITY MAGNETIC SEPARATION PROCESS FOR BENEFICIATION OF PLATINUM ORE

BACKGROUND OF THE INVENTION

1. Field of the Invention

The invention is directed to a method to beneficiate platinum and platinum group element ores contained in selected sediments (e.g., beach and alliuvium samples in the area near Good News Bay, Alaska) by magnetic separation.

2. Discussion of Prior Art

The recovery of by-product heavy minerals from gravel, various sediments and industrial mineral operations is of great commercial interest. For example, the Bureau of Mines has investigated such recovery as part of a continuing effort to maximize the recovery of minerals and metals within the United States. Heavy mineral concentrates (HMC), also referred to as black sands, were early investigated by the U.S. Geological Survey. Heavy minerals found, for example, in California black sands include magnetite, ilmenite, hematite, chromite, zircon, garnet, scheelite, cinnabar, gold and platinum-group metals (PGM). All of these minerals hve economic potential, however, few successful or commercially feasible means, except for gold, for recovering such minerals as by-products from sand and gravel operations have been discovered.

Beneficiation techniques such as gravity concentration and fractionation of heavy-mineral concentrates are known techniques. See for example, Report of Investigations 8366, Recovering By-Product Heavy Minerals from Sand and Gravel, Placer Gold, and Industrial Mineral Operations by J. M. Gomes, G. M. Martinez, and M. M. Wong, [Washington]: United States Department of the Interior, Bureau of Mines, 1979.

The use of conventional magnetic separators to remove ferromagnetic minerals is known. Magnetic separation is an important process that has been used in mineral dressing for many years. Most metallic ores are crushed and the values are concentrated using flotation, gravity settling, electrostatic separation, or other special processes. Test work conducted on several metallic ores using a wet magnetic mineral separator has been reported. John B. Mertie, Jr., U.S. Geological Survey Prof. Paper 938 (1976) disclosed an analytical process wherein magnetite was removed from various minerals without the inclusion of other minerals. However, no work has been reported using new high intensity, high gradient magnetic separators on metallic ores. The method disclosed herein to isolate paramagnetic fractions contained in various sediments to beneficiate platinum group element ores therein is, therefore, believed to be novel.

SUMMARY OF THE INVENTION

Beneficiation, in accordance with the invention, is generally accomplished by a differential magnetic filtration/separation process that removes ferromagnetic and diamagnetic materials from platinum or platinum group ore containing paramagnetic fractions. In addition to platinum, platinum group elements (PGE) include iridium, palladium, rhodium, osmium and sometimes ruthenium.

Differential magnetic separation procedures as disclosed herein can further beneficiate platinum in beach sands which have previously been subjected to field sluicing methods and simple screening. Most of the platinum in the HMC is associated with minerals of weak magnetic susceptibility and little, if any, with non-magnetic minerals. After removal of material of strong magnetic susceptibility (e.g., magnetite), the platinum fraction can be concentrated by high intensity magnetic filtration techniques. This can be especially useful for beneficiating platinum ores from fine-grained minerals and low energy placer deposits. Coupled, the above referred to methods can give a significantly upgraded fraction with a recovery efficiency of platinum of 75% or more.

DESCRIPTION OF SPECIFIC EMBODIMENTS

The heavy minerals concentrate used in the following exemplary remarks were obtained from a narrow zone of beach sediments near Good News Bay, Alaska. More than 90% of the platinum in the samples is concentrated by a factor of about 200 (to about 40 ppm) by simple sluicing and screening operations. Most of the platinum in these beach sands is associated with fine-grain minerals (500 microns), with the finest size material (100 microns) containing the highest platinum values (400–500 ppm). These materials generally exhibit weak magnetic susceptibility. A differential magnetic separation procedure is then used to beneficiate the sluiced/screened heavy minerals concentrate.

It is expected that a coupled sluicing/screening/differential magnetic separation of this type of beach sands can concentrate platinum by a factor of 250 to give a mineral fraction containing about 300 ppm platinum with a recovery efficiency of about 75%.

After arrival at the laboratory, the wet HMC was dried and divided into several representative batches by coning and quartering as described in the A. F. Taggart (ED) Handbook of Mineral Dressing, John Wiley, New York, 1922, (1945). Size fractionation of the various batches was effected by either hand or mechanical screening procedures.

Analyses for PGE were performed in-house using standard techniques. These analyses were carried out by standard fire assay methods. Collected samples were also analyzed for additional elements. Dispersive X-ray spectrometric and SEM techniques were used to obtain qualitative elemental analyses of some samples. Because reliable average values can only be obtained by analysis of larger sample base, the reported metal values should be considered semi-quantitative rather than quantitative.

The following modified separation method used alnico magnets to give a differential magnetic separation of the HMC:

Fractions of the HMC are spread evenly and thinly on a large sheet of paper so that the various minerals do not overlap. Magnetite is removed without the inclusion of other minerals by passing a small alnico horsehoe magnet over the concentrates at a distance of $\frac{1}{4}$–$\frac{1}{2}$ inch, it is necessary to lift the magnetite in a single operation because grains of magnetite placed in a strong magnetic field often become miniature magnets that can adhere in clumps, enclosing other nonferromagnetic minerals.

The principal accessory minerals, other than magnetite, are ilmenite, chromite, and olivine: other minerals are present in smaller amounts. Approximate separations into three additional fractions are made by using two other alnico horseshoe magnets of increasingly higher magnetic intensity (measured in gauss), utilizing the same technique as for magnetite except that the separates are obtained by contact. Because the magnetic susceptibility and density of ilmenite are only slightly greater than for chromite, the first of the three fractions is made up of ilmenite, chromite and a small part of the olivine.

The second fraction consists of olivine and other minerals of similar magnetic susceptibility, including epadote and garnet, if present. The third fraction includes the remaining minerals that are so weakly paramagnetic or diamagnetic that they are not held by the strongest alnico magnet.

A laboratory model magnetic pully separator was used for the semi-continuous separation of type "a" minerals (mainly magnetite) from the HMC. Attached to the drum are strips of an adhesive-backed flexible magnet. Heavy gauge polyethylene was used for the belt material.

The magnetic belt separator was used to remove the type "a" material. The type "a" free portion was then run through the electromagnetic unit. A circular plexiglass cell, having an inlet and an opposed outlet, was constructed to fit between the poles of the electromagnet. Non-metallic stainless steel shavings were packed in the cell and held in place by stainless steel screening. With the cell between the pole pieces and the power on, a slurry containing the magnetite-free material was fed to the cell inlet. As the slurry passed through the magnetic field, the paramagnetic particles were retained and the non-magnetic material continued downward through the cell outlet and was fed to a receiving flask. Here the solids settled, allowing the water to be recirculated to the inlet tubing where additional magnetite-free material was added.

After all the material had passed through the cell the pump was stopped, the outlet lines closed, and the receiving flask removed. A new receiving flask was connected to the line and power to the magnet turned off. The paramagnetic material held in the cell then dropped down through the outlet into the new receiving flask.

It is to be understood that this invention is not limited by the Example described herein below, which is as an example should be, merely exemplary.

EXAMPLE

A beach sediment containing 80.5 wt. % cobbles and pebbles (diameter>2 mm), 14.5 wt. % coarse sands (<2 mm, >0.5 mm diameter), and 5 wt. % medium sands and finer materials (diameter <0.5 mm) was used.

The cobbles, pebbles, and coarse sand do not contain significant quantities of platinum (i.e., Pt<0.03 ppm) and are removed from the finer grained materials by screening.

The <0.5 mm diameter material represents 5 wt. % of the total sample and (according to analyses of small size samples) contains about 50 ppm platinum. Ferromagnetic minerals (mainly magnetite by microscopic examination) were magnetically removed from the bulk using a relatively weak magnetic field of from about 10 gauss to about 100 gauss. This mineral fraction contains about 0.3% of the total platinum.

The paramagnetic materials are magnetically removed from the <0.5 mm diameter sediments using a relatively strong magnetic field of from about 100 gauss to about 20 kilogauss. Analysis of this material indicates that more than 90% of the total sedimentary platinum resides in this fraction which comprises about 1% of the total weight of the sediment.

The remaining diamagnetic material (not magnetically removed) contains about 8% of the total platinum in about 3% of the total sediment weight. It should be noted that this fraction may hold weakly paramagnetic minerals containing platinum, and that a more effecient magnetic system (e.g., high-field, high-intensity) might improve the overall platinum and platinum group metals recovery.

The above described magnetic upgrading can be coupled with other heavy minerals beneficiation methods such as flotation, sedimentation processes and the like. This concept can be applied to the beneficiation of paramagneatic platinum group elements from various worldwide deposits including, but not limited to those in Alaska.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

I claim:

1. A process for recovering platinum and platinum group element ores from sediments comprising (1) screening the sediment until substantially all coarse material having a diameter larger than about 2 mm is removed; (2) magnetically separating and removing strongly magnetic minerals from the remaining sediment with a weak magnetic field having a force of from about 10 gauss to about 100 gauss; (3) removing the paramagnetic materials with a strong magnetic field having a force of from about 100 gauss to about 20 kilogauss; and (4) separating and recovering the platinum ores and/or platinum group element ores therefrom leaving a diamagnetic residue.

2. The process of claim 1 directed to the recovery of platinum ores.

3. The process of claim 1 directed to the recovery of platinum group element ores.

4. The process of claim 3 wherein the platinum group ores are selected from the group consisting essentially of iridium, palladium, osmium and rhodium.

5. The process of claim 1 wherein the sediment is selected from the group consisting essentially of marine, estuarine and riverine sedimentary deposits.

6. The process of claim 5 wherein the sediment is a beach sediment.

7. The process of claim 6 wherein flotation and/or sedimentation steps are incorporated therein.

8. The process of claim 6 wherein prior to screening the sediments are subjected to sluicing.

9. A method for isolating the paramagnetic fractions of a sediment selected from the group consisting essentially of marine, estuarine and riverine sedimentary deposits and beneficiating the platinum and platinum group element ores contained therein in a differential magnetic filtration separation process comprising (1) removing fractions of the sediment larger than about 2 mm by screening (2) separating and removing the ferromagnetic materials from the remaining sediment with a weak magnetic force of about 10 gauss to about 100 gauss followed by (3) isolation of the paramagnetic fraction by use of a stronger magnetic force having a strength of from about 100 gauss to about 20 kilogauss and recovering the platinum or platinum group element ores.

* * * * *

UNITED STATES PATENT AND TRADEMARK OFFICE

CERTIFICATE OF CORRECTION

PATENT NO. : 4,543,178

DATED : September 24, 1985

INVENTOR(S) : Theodore P. Goldstein

It is certified that error appears in the above-identified patent and that said Letters Patent is hereby corrected as shown below:

Column 4, line 52, (Claim 8), change the dependency from "claim 6" to --claim 1--.

Signed and Sealed this

*Eleventh* Day of *March 1986*

[SEAL]

*Attest:*

DONALD J. QUIGG

*Attesting Officer*

*Commissioner of Patents and Trademarks*